United States Patent [19]

Nakai

[11] Patent Number: 4,770,013

[45] Date of Patent: Sep. 13, 1988

[54] COMBINATION LOCK

[75] Inventor: Hatsuo Nakai, Toyonaka, Japan

[73] Assignee: Clover Co., Ltd., Osaka, Japan

[21] Appl. No.: 113,571

[22] Filed: Oct. 26, 1987

[30] Foreign Application Priority Data

Mar. 31, 1987 [JP] Japan ..... 62-80360
May 18, 1987 [JP] Japan ..... 62-120617

[51] Int. Cl.[4] ..... E05B 37/00

[52] U.S. Cl. ..... 70/285; 70/314; 70/316

[58] Field of Search ..... 70/285, 284, 21, 314, 70/315, 316, 317, 318, 312, 309, 304, 305, 306, 308

[56] References Cited

U.S. PATENT DOCUMENTS 2,580,830 1/1952 Pelle ..... 70/285
3,447,348 6/1969 Davenbaugh ..... 70/285
3,633,388 1/1972 Atkinson ..... 70/285
3,903,718 9/1975 Fish ..... 70/156

*Primary Examiner*—Robert L. Wolfe
*Attorney, Agent, or Firm*—Jordan and Hamburg

[57] ABSTRACT

The present invention is of a lock applied to an opening/closing part of a locker for rent or the like, and in a movable member of a door or the like, a combination lock is constituted with a locking mechanism having a cam plate engaging with and disengaging from a catching part of a main unit side and a dial lock having a plurality of dials defining movement of an operation shaft which is disposed in connection with this locking mechanism and engages with and disengages from the movable shaft member of the locking mechanism to define the movement thereof, and particularly in the present invention, a mechanism wherein the utilizer can arbitrarily set numerals for unlocking in the dial lock and a dial restoring mechanism, which restores all numerals of the respective dials to the position of zero after setting of numerals for unlocking are installed.

5 Claims, 7 Drawing Sheets

COMBINATION LOCK

BACKGROUND OF THE INVENTION

The present invention relates to a combination lock which is applied to various opening/closing parts for safes, lockers, strong rooms and others.

Conventionally, in a locker for rent, for example, a lock which is opened and closed by a peculiar key is installed on a locker basis.

The user of a locker is to carry the key, and therefore accidents of theft due to loss or dishonest use of a locker key have happened frequently.

These troubles can be eliminated by applying a code lock using numerals 1–0 which requires no key. However, in the conventional code locks, numerals used for unlocking are determined by a mechanical structure on a lock basis. Numerals used for unlocking can be changed by adjusting the mechanical structure inside the lock, but in order to change the numerals for unlocking, a lever or a pin has to be operated from the side surface or the rear surface of the lock main body, and in the case of the locker used always by many unspecified persons, it is impossible to change the numerals for unlocking every time of use. Also, in the case where no numerals are changed, a problem remains that unlocking is made by another person by memorizing the numerals.

To accommodate for this problem, recently electric type code locks have appeared.

In the electric type code lock, the user of a locker touch-operates keys 1–0 on a key-board disposed on a lock case to determine arbitrary numerals for unlocking while watching digital numerals appearing on a display, and thereafter by locking a locking mechanism, the numerals are stored in an electronic circuit in the lock as numerals for unlocking, thereby the locked stated being kept.

However, in the case of the electric type code lock, a problem remains that should a power failure occur even for an instant, the numerals for unlocking stored in the electronic circuit go wrong or be lost. Also, the electric type code lock has disadvantages that it not only consumes electric power all the time but also the price of the lock becomes expensive as much as about ¥100,000 per unit when the installation cost is included.

SUMMARY OF THE INVENTION

A combination lock in accordance with the present invention comprises a locking mechanism wherein a cam plate is fixed to a shaft member rotated by finger operation or key operation, a mechanism which consists of an operation shaft which is disposed in connection with this locking mechanism and engages with and disengages from the shaft member to define the operation thereof and a dial lock having a plurality of dials which are journaled on the operation shaft and define the movement of the operation shaft, and sets an arbitrary numeral for unlocking for each dial of this dial lock, and a dial restoring mechanism which rotates each dial all together by a push button operation to restore numeral 0 of each dial to the unlocking position.

Therefore, the principal object of the present invention is to provide a novel combination lock which is a combination lock of a locking mechanism of cam plate system and a dial lock of mechanical structure, and wherein numeral used for unlocking of each dial in the dial lock can be set arbitrarily by the user of the lock, and which thereby exerts an excellent effect as a locking apparatus for a locker for rent or the like which is utilized by many unspecified persons.

The above-described object, features and effect of the present invention will become more apparent from the following detailed description made in reference to accompanying drawings.

DETAILED DESCRIPTION OF THE PREFERRED EMBODIMENTS

Figure 1:
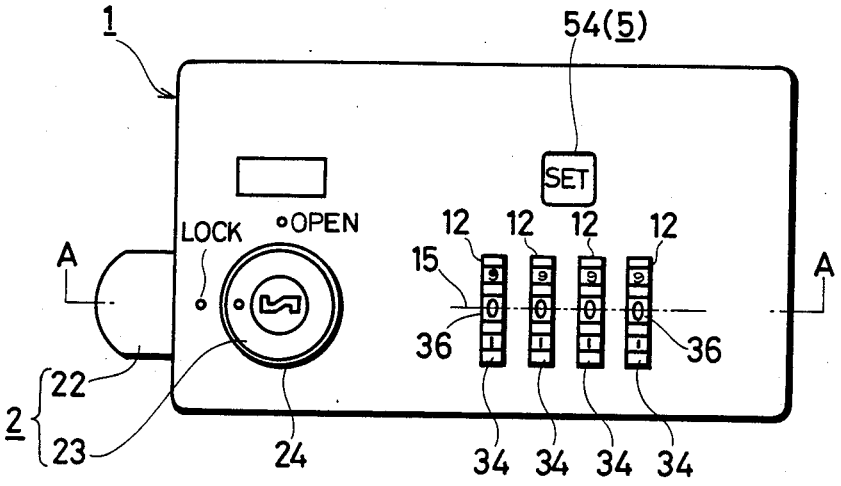
FIG. 1 is a front view of a combination lock of one embodiment in accordance with the present invention.

FIG. 1 is a view showing a combination lock of one embodiment in accordance with the present invention.

This combination lock is to be constituted inside a housing 1 mounted on and fixed to a movable side of a door or the like, and comprises a locking mechanism 2 which is disposed in the housing and wherein a cam plate 22 is fixed to a shaft member rotated by finger operation or key operation, a mechanism which consists of an operation shaft 30 which is disposed in connection with this locking mechanism and engages with and disengages from the shaft member to define the operation thereof and a dial lock 3 having a plurality of dials 34 which are journaled on the operation shaft to define the movement of the operation shaft, and sets an arbitrary numeral for unlocking for each dial of this dial lock, and a dial restoring mechanism which rotates each dial all together by a push button operation to restore numeral 0 of each dial to the unlocking position.

Figure 2:
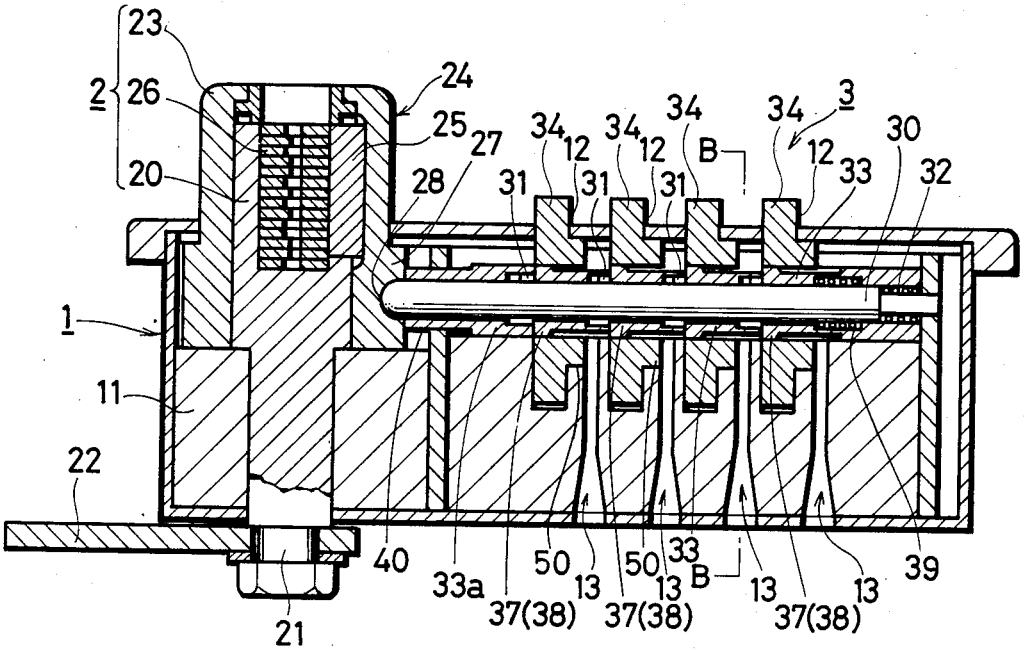
FIG. 2 is a magnified cross-sectional view taken along line A—A in FIG. 1.
Figure 3:
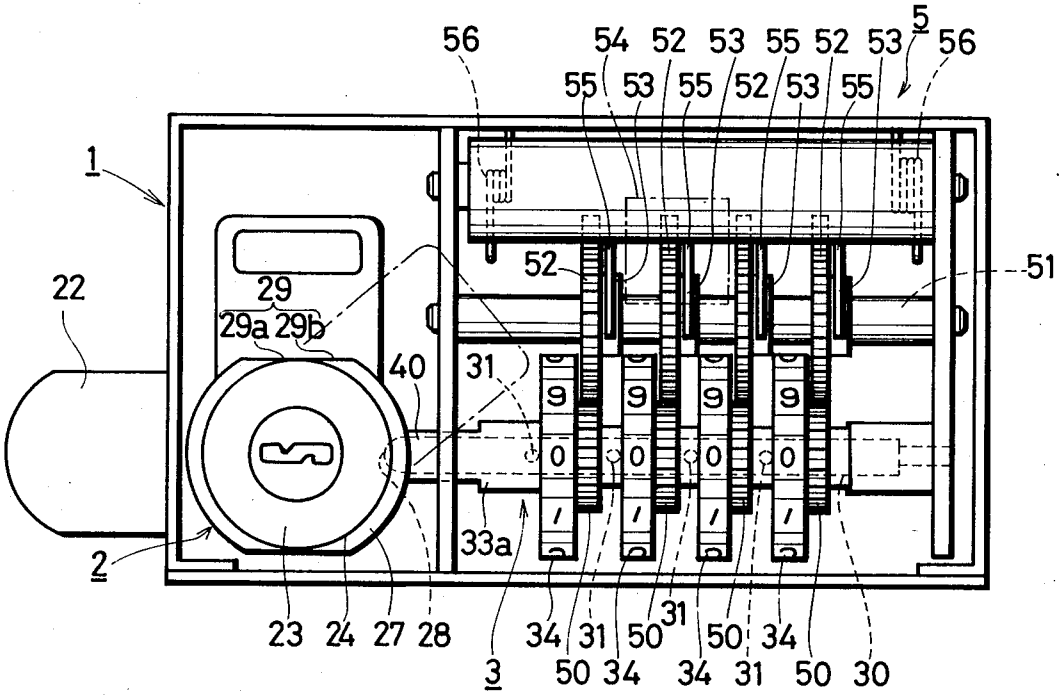
FIG. 3 is a view showing an inner mechanism.

The above-mentioned locking mechanism 2 applies a cylinder lock. The cylinder lock, as shown in FIG. 2 and FIG. 3, has a mounting shaft 21 to the bottom end of which the cam plate is fixed, and comprises an inner cylinder 20 wherein this mounting shaft 21 is journaled in a bearing member 11 in the housing 1, an outer cylinder 23 which is journaled on this inner cylinder 20 and forms an operating knob 24 by protruding the upper part thereof outside the housing 1, a side bar 25 which is disposed between the inner cylinder 20 and the outer cylinder 23 and appears on and disappears from a shear line to define the rotations of the inner and the outer cylinders, and a disc tumbler 26 which makes an unlocking operation of the side bar 25 by inserting a key disposed in the inner cylinder 20. When the knob 24 is knob-rotated, the cam plate 22 including the inner and the outer cylinders 20 and 23 is rotated forward and backward, and engages with and disengages from a catching part (not illustrated) of the main unit side, making so-called locking and unlocking.

Figure 5:
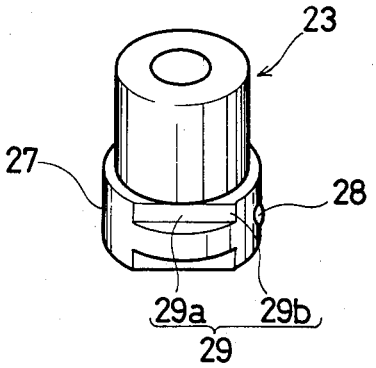
FIG. 5 is a perspective view of an outer cylinder of a cylinder lock.

In the outer cylinder 23, as shown in FIG. 2 and FIG. 5, a collar 27 is formed at the lower part thereof. On this collar 27, a locking recess 28 is formed which engages with the operation shaft corresponding to the dial lock when the cam plate 22 is located at the locking position.

The dial lock 3 is composed of the operation shaft 30 which is disposed in a manner capable of reciprocating motion in the housing 1 corresponding to the abovementioned locking recess 28 and has a plurality of protrusions 31 on the side surface of the shaft at equal intervals, a spring 32 elastically energizing the operation shaft 31 to the locking recess 28 side, and a plurality of dials 34 which are journaled rotatably on this operation shaft 30 through bushes 33 and whose outer peripheries are protruded partly from window holes 12.

In the bush 33 of each dial 34, a line of protrusion-engaging groove 35 is formed in the axial direction. Also, on the outer periphery of the dial 34, numeral 36 such as 1, 2, 3 or the like is displayed, and any one of the numerals 36 corresponds to the protrusion-engaging groove 35. The operation shaft 30 is so constituted as to slide by forward or backward rotation of the outer cylinder 23 by locking or unlocking of the cam plate 22 when the protrusion-engaging groove 35 of each dial 34 engages with the protrusion 31 on the shaft.

In the above-mentioned each dial 34 and bearing hole portion of the bush 33, protrusion lines 37 concave grooves 38 are formed whose numbers are matched with the number of numerals on the outer periphery of the dial. The adjacent bushes 33 butt each other on the end faces, and energize elastically the spring 39 to disengage the protrusion line 37 from the concave groove 38 in a connection manner. In a bush **33*a* nearest the cylinder lock, an operating piece 40 engaging with the outer cylinder 23 is installed in a protruded fashion, while in the collar 27 of the outer cylinder 23, a cam 29 is formed which engages the protrusion line 37 with the concave groove 38 by pushing the bush 33 against a spring force when the cam plate 22 is located at the locking position, and in reverse, disengages the protrusion line 37 from the concave groove 38 by allowing the bush 33 to move when located at the unlocking position. Accordingly, when the cam plate 22 is located at the unlocking position, the operation shaft 30 is pushed out of the recess 28 of the outer cylinder 23. Also, the protrusion 31 on the shaft engages with the protrusion-engaging groove 35 of each bush 33. On the other hand, in the bush 33, the operating piece 40 is positioned at a lower part 29*a* of the cam 29 and moves to the outer cylinder 23 side along with each bush 33. Thereby, the engagement of the protrusion line 37 with the concave groove 38 between the bush 33 is released to make the dial 34 rotate freely, that is, the locking mechanism is unlocked, and thereby a mechanism is constituted wherein the previous combination of numerals for unlocking is cleared when a new numeral of each dial is set at the unlocking position, and new numerals are set as numerals for unlocking by locking the locking mechanism 2**.

Figure 4:
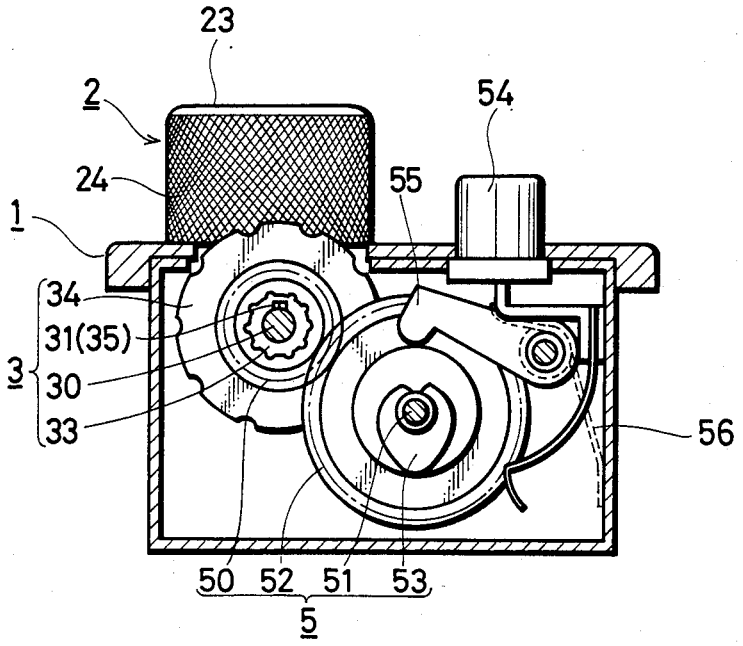
FIG. 4 is a cross-sectional view taken along line B—B in FIG. 2.

A dial restoring mechanism 5 restoring numeral of each dial all together to zero, as shown in FIG. 3 and FIG. 4, is constituted with a gear 50 formed integrally on the side surface of each dial 34, a transmission gear 52 which is journaled rotatably on a support shaft 51 disposed in parallel with the operation shaft 30 and engages with the above-mentioned each gear 50, a heart-shaped eccentric cam 53 formed on the side surface of the transmission gear 52, a push button 54 disposed in the housing 1, and an operating arm 55 which is disposed in connection with the push button 54 and pushes each eccentric cam 53 back to a predetermined position. This operating arm 55 is pressed elastically to the push button 54 side by a spring 56, raising the push button 54. Accordingly, the numeral 36 used for unlocking of each dial 34 is set, the locking mechanism 2 is locked, thereafter the push button 54 is pushed, and thereby the operating arm 55 presses the corresponding eccentric cam 53 to rotate each dial 34 all together through the transmission gear 52 and the gear 50 of the dial, and thereby numeral 0 of each dial 34 is to be aligned on a line 15 of the housing 1.

The above-mentioned combination lock is provided with an unlocking means in the case where the numerals 36 used for unlocking are forgotten or where the user makes a wrong locking without watching the numerals.

This retrieving means is constituted in a manner that a guide hole 13 which faces each bush 33 and communicates therewith is drilled on the rear surface of the housing 1, while a pin hole (not illustrated) facing the guide hole 13 is installed in a concave fashion in each bush 33. Accordingly, a predetermined key is inserted into the inner cylinder 20, the side bar 25 between the inner and the outer cylinders is made to retreat from the shear line, and the cam plate 22 is unlocked by a key operation, and thereafter a guide pin of wire or the like is inserted through the abovementioned guide hole 13 to rotate the corresponding dial 34. At this time, the guide pin stops by engaging with the pin hole when it corresponds to this pin hole, and the numerals 36 used for unlocking are positioned on the line 15 at this time, and thereby a trouble of forgetting numerals or the like can be treated.

In addition, although not shown in the drawing, in the practical use, a lock other than the cylinder lock may be applied also in the locking mechanism 2. Also, a configuration with a simple manipulating shaft can be applied that an operating knob is installed at one end thereof and a cam plate is fixed to the other end thereof. In this case, the collar is fixed to the manipulating shaft corresponding to the operation shaft, and a locking recess and a cam are formed.

Next, description is made on the operation of the above-mentioned embodiment. Now, when the cam plate 22 is located at the unlocking position, the operation shaft 30 of the dial lock engages with a recess for unlocking (not illustrated) formed on the collar 27 of the outer cylinder 23, and each protrusion 31 is positioned in the dial. On the other hand, in each bush 33, the operating piece 40 is positioned at the lower part **29*a* of the cam 29, and the protrusion line 37 and the concave groove 38 are disengaged, and each dial 34** is put in the state of free rotation.

At this time, arbitrary numerals 36 used for unlocking are aligned on the dial stop line 15 of the housing 1. Subsequently, the locking mechanism 2 is rotated by a knob operation, and thereby the cam plate 22 is engaged with the catching part of the main unit side to be locked. The operation shaft 30 gets out of the unlocking recess of the outer cylinder collar 27, engaging with the locking recess 28. In the bush 33, the operating piece 40 is positioned at a high part **29*b* of the cam 29, and the protrusion line 37 and the concave groove 38 between each dial 34 engage with each other, and the protrusion 31 on the operation shaft gets out of the protrusion-engaging groove 35, and the above-described numeral for unlocking is set. In this state, the push button 54 of the zero restoring mechanism is depressed. Thereby, the operating arm 55 rotates the corresponding eccentric cam 53, rotates each dial 34 all together through the transmission gear 52 and the gear 50, alignes numeral for unlocking 0 of each dial on the line 15 of the housing 1, checks the movement of the operation shaft 30**, thereby holding the locked state.

Next, in the case of unlocking, first the numeral for unlocking 36 of each dial 34 previously set is positioned on the dial stop line 15 of the housing 1. Subsequently, the operating knob 24 is rotated reversely, and thereby the locking recess 28 of the outer cylinder 23 makes the operation shaft 30 retreat against the spring force 32, and the cam plate 22 is disengaged from the catching part of the cam plate 22 to be unlocked, and each dial 34 is put again in the state of free rotation, being placed in the state that new numerals for unlocking can be set.

In the combination lock of this embodiment, when the numerals 36 used for unlocking have been forgotten, or a wrong locking has been made without watching the numerals, in order to unlock, an adaptable key (not illustrated) is inserted into the inner cylinder 20 through a key hole drilled in the operating knob 24. At this time, the disc tumbler 26 operates the side bar 25, and cuts off relation to the outer cylinder 23, thereby enabling independent rotation of the inner cylinder 20. In this state, by rotation-operating the key in the same direction as that of the operating knob 24, the inner cylinder 20 is rotated around the shaft with the outer cylinder 23 left intact. Since the cam plate 22 is fixed to this inner cylinder 20, unlocking can be made. Thereafter, the door is opened, and the guide pin is inserted from the guide hole 13 of the rear side of the housing 1 while rotating the dial 34, the pin hole of the bush 33 is looked for, the numerals for unlocking 36 are made sure, and thereby a trouble of forgetting numerals or the like is treated.

Figure 6:
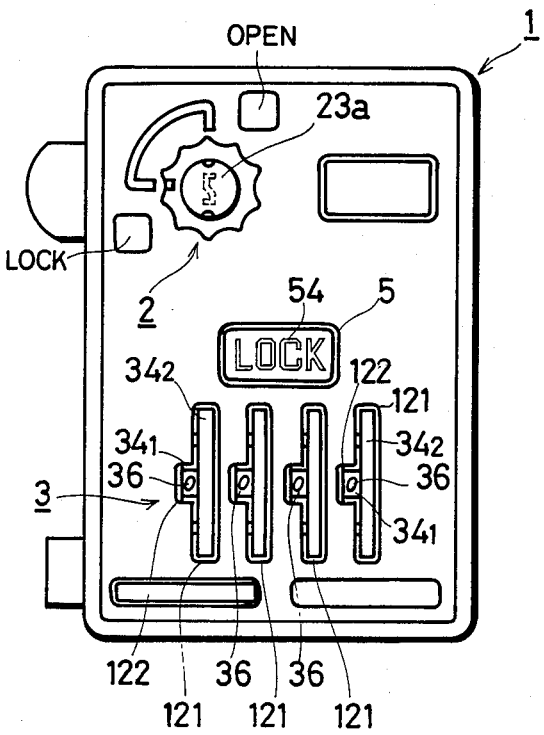
FIG. 6 is a front view of a combination lock of a second embodiment in accordance with the present invention.
Figure 7:
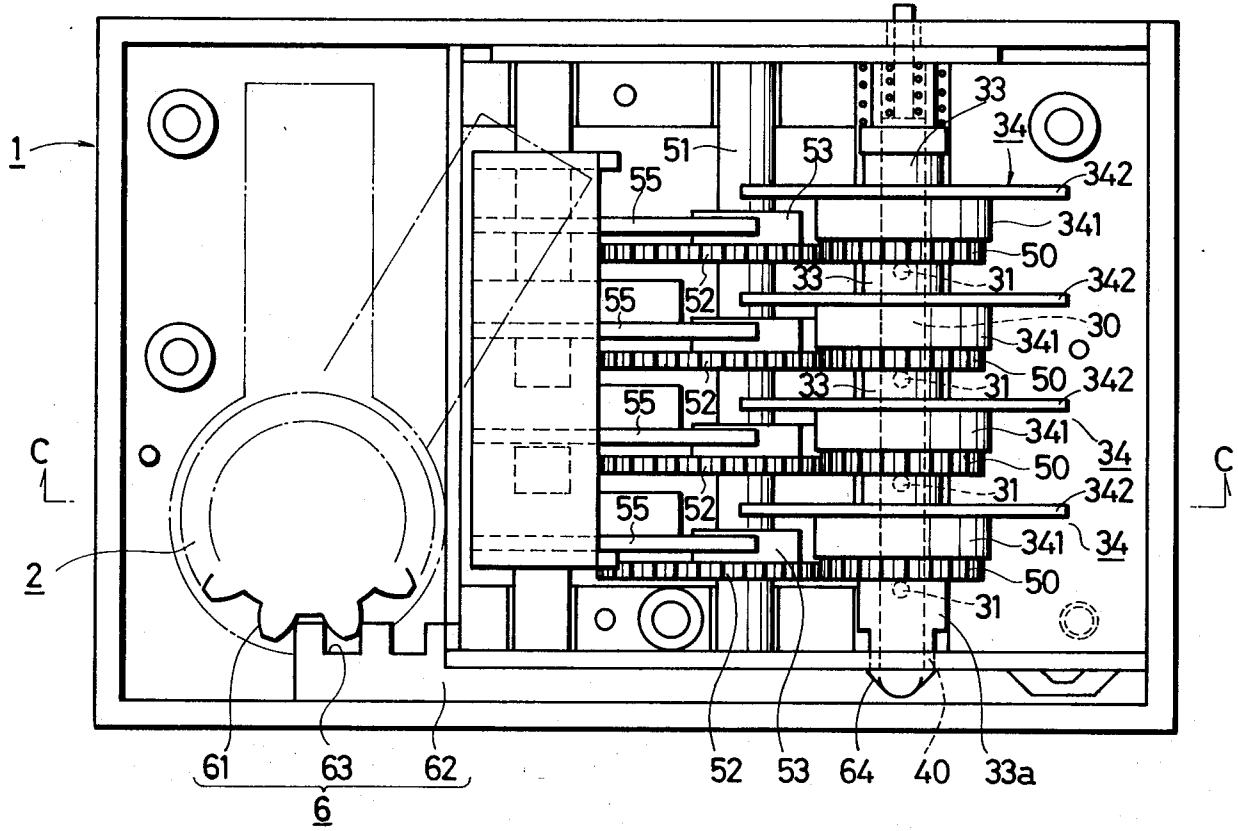
FIG. 7 is a view showing an inner mechanism of FIG. 6.
Figure 8:
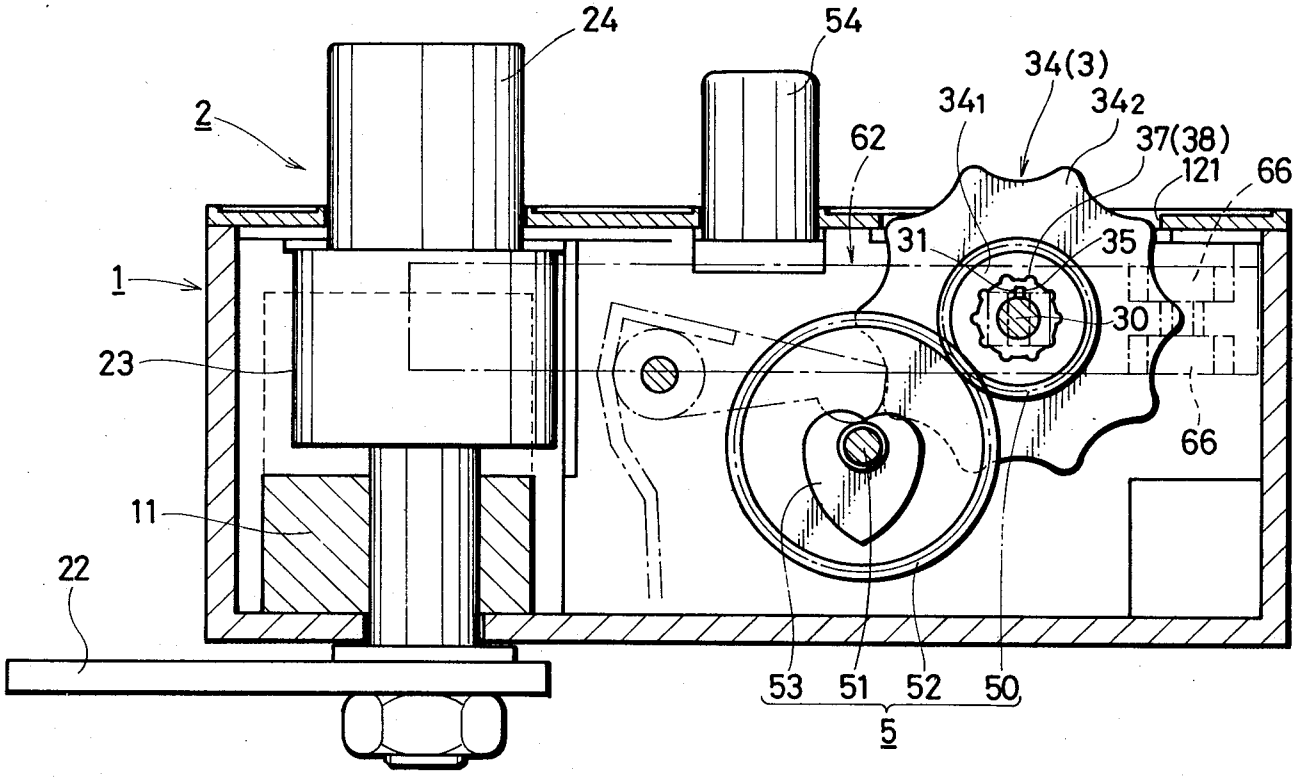
FIG. 8 is a cross-sectional view taken along line C—C in FIG. 7.

FIG. 6 through FIG. 8 show a second embodiment of the combination lock in accordance with the present invention. The combination lock of the above-described example has a lateral configuration wherein the dial lock 3 is disposed at the side of the locking mechanism 2, while the combination lock of this embodiment has a longitudinal configuration wherein the locking mechanism 2 and the dial lock 3 are disposed at upper and lower positions and the locking mechanism 2 and the dial lock 3 are connected by a transmission means 6.

Hereinafter, detailed description is made on configuration of this second embodiment. The locking mechanism 2 and the dial lock 3 have nearly the same configurations as those of the first embodiment, and here the description thereon is omitted by designating the corresponding portions by the corresponding symbols.

Figure 9:
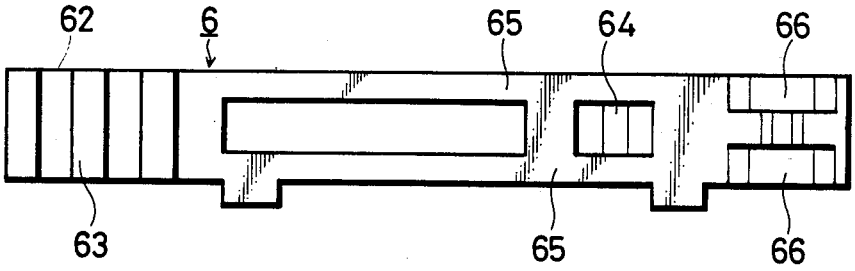
FIG. 9 is a front view of a slide plate.
Figure 10:
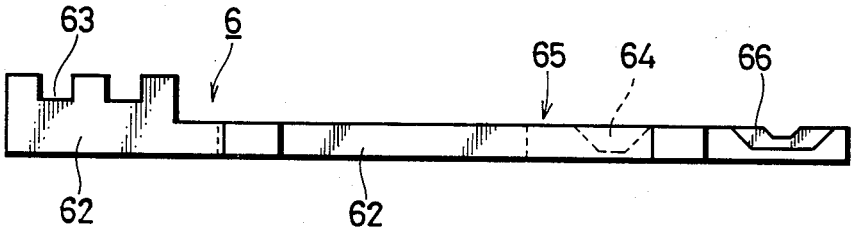
FIG. 10 is a plan view of FIG. 9.

In the same views, in this transmission means 6, a transmission gear 61 is installed in the shaft member of the locking mechanism 2. Also, as shown in FIG. 9 and FIG. 10, it is provided with a slide plate 62 at one end of which a rack 63 engaging with the above-mentioned transmission gear 61 is formed and at the other end of which an engaging recess 64 engaging with and disengaging from the operation shaft 30 of the dial lock 3 is formed. Accordingly, when the protrusion-engaging groove 35 of each dial 34 corresponds to the protrusion 31 on the operation shaft 30, the slide plate 62 makes reciprocating motion by forward and reverse rotations of the transmission gear 61 due to locking and unlocking of the cam plate, and the operation shaft 30 slides likewise the above-described example by engaging with and disengaging from the engaging recess 64.

In this embodiment, a defining means is installed which limits the visible range of the numeral 36 on the outer periphery of each dial 34 of the dial lock 3 to the front side of the dial.

This defining means is configurated in each dial 34 and the housing 1, and the dial 34 has an operating flange 342 protruding to the outer periphery on one side of a dial main body 341 where the numerals 36 of 1–0 are disposed on the outer periphery thereof. On the other hand, in the housing 1, slit-shaped window holes 121 whereto the operating flanges 342 are adaptable are provided, and at one side of this window hole 121, a peep window 122 corresponding to one numeral on the outer periphery of the dial main body 341 is formed in a series fashion. Accordingly, part of the operating flange 342 protrudes through the slit-shaped window hole 12 and shields the side of the peep window 122, and one numeral 36 on the dial main body 341 is positioned inside the peep window 122, and thus the visible range of the numeral 36 is limited to the front side of the dial.

Figure 11:
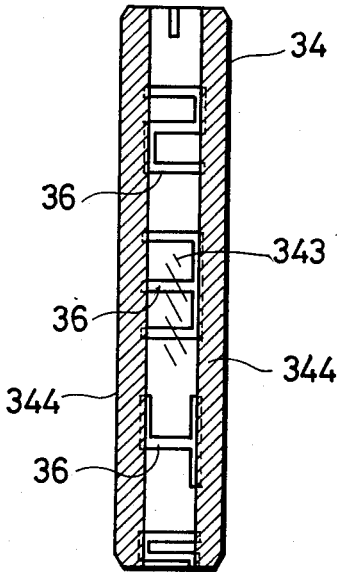
FIG. 11 is a view showing another example of the dial.

FIG. 11 shows another example of the visible range defining means. In this embodiment, the numerals 36 of 1–0 are indicated on the outer periphery of each dial 34, and a transparent film 343 having a suitable thickness is formed on the outer peripheral surface including the numeral 36, and a shielding part 344 having ground-glass-like rough surface, colored surface or the like is formed on the surfaces of both sides with the portion corresponding to the numeral 36 left intact, and thus the visible range of the numeral 36 is limited to the front side of the dial 34.

The dial 34 of the above-mentioned each embodiment, needless to say, can be applied practically also to the combination lock as shown in FIG. 1.

In the embodiment in FIG. 6, likewise the above-described example, the protrusion lines 37 and the concave grooves 38 whose numbers match with the number of the numerals 36 of the outer periphery of the dial are formed in each dial 34 and the bearing hole of the bush 33, and the adjacent bushes 33 butt each other on the end surfaces thereof, and elastic energizing is made by the spring 39 so that the protrusion line 37 disengages from the concave groove 38. The operating piece 40 is installed in a protruded fashion on the bush **33*a* near the slide plate 62. On the other hand, in the slide plate 62, a support surface 65 supporting the bush operating piece 40 when the cam plate 22 is located at the locking position and a recess 66 allowing the bush 33 to move by engaging with the operating piece 40** when located at the unlocking position are formed.

In this embodiment, the dial restoring mechanism 5 restoring the numeral of each dial 34 to zero, likewise the above-mentioned first embodiment, is constituted with the gear 50 formed integrally on the side surface of each dial 34, the transmission gear 52 which is journaled rotatably on the support shaft 51 disposed in parallel with the operation shaft 30 and is engaged with the above-mentioned each gear 50, the eccentric cam 53 formed on the side surface of the transmission gear 52, the push button 54 disposed in the housing 1 and the operating arm 55 which is disposed in connection with the push button 54 and pushes each eccentric cam 53 back to a predetermined position, and operates like wise the above-described example, and therefore description on this embodiment is omitted.

The locking mechanism 2 is cylinder lock having the same structure as that of the above-described example, and in this embodiments, the transmission gear 61 engaging with the rack 63 of the slide plate 62 is formed on the outer periphery of the outer cylinder 23 acting as a shaft member. Also, on the top end surface of the outer cylinder 23, a recess is formed corresponding to the key hole portion, and a blocking plate 23*a* composed of a flexible sheet material is fitted to this recess to block the key hole. The inner structure of the cylinder lock is the same as that of the above-described example, and therefore description thereon is omitted.

In the above-mentioned second embodiment, operation of the locking mechanism 2, setting of numerals for unlocking, dial restoring operation of numerals for unlocking, and retrieving operation when numerals for unlocking have been forgotten are all the same as those of the above-described example, and therefore description thereon is omitted. Also, in this embodiment, the numeral 36 of each dial 34 is positioned in the peep window 122 of the housing 1, and also this peep window 122 is positioned between the operating flange 342 of each dial 34 and is hidden, therefore being never peeped from sideways. According, an effect is exerted that the visible range is limited to the front side of the dial and thereby the conventional disadvantage is eliminated.

Hereinbefore, the present invention has been described by way of the preferred embodiments, and it will be apparent to those skilled in the art that various modifications and changes may be made therein within the scope not departing from the spirit of the present invention, accordingly the scope of the present invention being limited only by the terms of the appended claims.

What is claimed is:

1. A combination lock comprising a locking mechanism wherein a cam plate is fixed to a shaft member rotated by finger operation or key operation, an operation shaft which is disposed in connection with this locking mechanism and defines operation of the shaft member and a dial lock having a plurality of dials which are journaled on this operation shaft through a bush and defines movement of the operation shaft, comprising:

a mechanism which sets an arbitrary numeral for unlocking for each dial of said dial lock, and a dial restoring mechanism which rotates each dial all together by a push button operation and restores numeral of each dial to the position of zero.

2. A combination lock in accordance with claim 1, wherein a retrieving mechanism retrieving numeral for unlocking set in each dial in installed in the dial lock.

3. A combination lock in accordance with claim 1, wherein a defining means limiting the numeral visible range to the front side of the dial is provided in each dial of the dial lock.

4. A combination lock in accordance with claim 1, wherein the locking mechanism comprises an inner cylinder journaled by a housing and a cylinder lock which is journaled by this inner cylinder and whose operating knob is formed in a manner of protruding the end part thereof outside the housing, and is lock comprising a mechanism capable of unlocking by releasing the dial for emergency in the case where the numerals for unlocking are unknown.

5. A combination lock in accordance with claim 1, wherein the dial restoring mechanism restoring all numerals to zero is constituted with a gear installed at the side surface of each dial, a transmission gear which is journaled rotatably on a support shaft disposed in parallel with the operation shaft and engages with said each gear, an eccentric cam formed on the side surface of each transmission gear, a push button disposed in the housing and an operating piece which is disposed in connection with the push butter and returns each eccentric cam to a predetermined position.

* * * * *